US006310510B1

(12) United States Patent
Goldman et al.

(10) Patent No.: US 6,310,510 B1
(45) Date of Patent: Oct. 30, 2001

(54) ELECTRONIC CIRCUIT FOR PRODUCING A REFERENCE CURRENT INDEPENDENT OF TEMPERATURE AND SUPPLY VOLTAGE

(75) Inventors: Richard Goldman; Robin Wilson, both of Cirencester (GB)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/691,261

(22) Filed: Oct. 19, 2000

(30) Foreign Application Priority Data

Oct. 20, 1999 (GB) ..... 9924876

(51) Int. Cl.[7] ..... E05F 1/10

(52) U.S. Cl. ..... 327/538; 327/542; 327/512; 327/513; 323/313; 323/315

(58) Field of Search ..... 327/512, 513, 327/378, 83, 538, 540, 541, 542, 543, 53, 66; 330/288; 323/312, 313, 314, 315

(56) References Cited

U.S. PATENT DOCUMENTS

| | | | |
|---|---|---|---|
| 3,930,172 | 12/1975 | Dobkin | 327/540 |
| 4,325,017 | 4/1982 | Schade, Jr. | 323/313 |
| 4,335,346 | 6/1982 | Streit | 323/313 |
| 4,491,780 | 1/1985 | Neidorff | 323/313 |
| 5,015,942 | 5/1991 | Kolanko | 323/315 |
| 5,430,395 | 7/1995 | Ichimaru | 327/312 |
| 5,557,194 | 9/1996 | Kato | 323/315 |
| 5,604,427 | 2/1997 | Kimura | 323/313 |
| 5,796,244 | 9/1998 | Chen et al. | 323/315 |
| 5,804,955 | 9/1998 | Tuozzolo et al. | 323/377 |
| 5,828,329 | 10/1998 | Burns | 341/155 |
| 5,900,772 | 5/1999 | Somerville et al. | 327/539 |
| 5,920,184 | 7/1999 | Kadanka | 323/314 |

FOREIGN PATENT DOCUMENTS

| | | |
|---|---|---|
| 0072589 | 2/1983 | (EP) . |
| 0131340 | 1/1985 | (EP) . |
| 0329232 | 8/1989 | (EP) . |
| 0429198 | 5/1991 | (EP) . |
| 0458332 | 11/1991 | (EP) . |
| 0483913 | 5/1992 | (EP) . |
| 0527513 | 2/1993 | (EP) . |
| 0632357 | 1/1995 | (EP) . |
| 2306709 | 5/1997 | (GB) . |
| 82/02964 | 9/1982 | (WO) . |

*Primary Examiner*—Timothy P. Callahan
*Assistant Examiner*—An T. Luu
(74) *Attorney, Agent, or Firm*—Burns, Doane, Swecker & Mathis, L.L.P.

(57) ABSTRACT

A current reference circuit comprises a positive temperature coefficient circuit and a negative temperature coefficient circuit, the temperature coefficients of which can be adjusted to give a temperature independent output current. The base of a transistor in the positive temperature coefficient circuit is connected to the base of a transistor in the negative temperature coefficient circuit to bias it.

4 Claims, 2 Drawing Sheets

ELECTRONIC CIRCUIT FOR PRODUCING A REFERENCE CURRENT INDEPENDENT OF TEMPERATURE AND SUPPLY VOLTAGE

This application claims priority under 35 U.S.C. §§119 and/or 365 to 9924876.7 filed in the United Kingdom on Oct. 20, 1999; the entire content of which is hereby incorporated by reference.

FIELD OF THE INVENTION

This invention relates to an electronic circuit, and in particular to a current reference circuit, which produces a reference current which is independent of temperature and supply voltage.

BACKGROUND OF THE INVENTION

A current reference circuit, implemented using bipolar transistors, is known from U.S. Pat. No. 4,335,346. U.S. Pat. No. 4,335,346 describes a circuit which has two sub-circuits. A first sub-circuit has a negative temperature coefficient, that is the current generated thereby varies inversely with temperature, and a second sub-circuit has a positive temperature coefficient, that is the current generated thereby varies directly with temperature. The first sub-circuit comprises an NPN transistor, the emitter terminal of which is connected through a resistor to ground. As is well known, the base-emitter voltage of a bipolar transistor varies inversely with the temperature. Thus, the current through the transistor, which depends on the voltage across the resistor and the resistance value thereof, will also vary inversely with the temperature. The circuit further includes means for summing the currents generated by the first and second sub-circuits to produce an output current.

SUMMARY OF THE INVENTION

The present invention relates to a circuit which has two sub-circuits. A first sub-circuit has a negative temperature coefficient, and a second sub-circuit has a positive temperature coefficient. The first sub-circuit comprises a first bipolar transistor, the emitter terminal of which is connected through a first resistor to a first voltage supply rail. Thus, the current through the first bipolar transistor varies inversely with the temperature.

The second sub-circuit comprises second, third, fourth and fifth bipolar transistors. The bases of the second and third transistors are connected together, and to the collector terminal of the third transistor. This terminal is further connected to a second voltage supply rail through a second resistor. The emitter of the second transistor is connected to the collector of a fourth transistor, and to the base of a fifth transistor. The emitter of the third transistor is connected to the collector of the fifth transistor, and to the base of the fourth transistor. The emitter of the fourth transistor is connected to the first voltage supply rail through a third resistor, and the emitter of the fifth transistor is also connected to the first voltage supply rail.

The current through the collector terminal of the second sub-circuit is the current generated by the circuit.

The circuit further includes means for summing the currents generated by the first and second sub-circuits to produce an output current.

Importantly, in accordance with the invention, the base of the second transistor, in the second sub-circuit, is connected to the base of the first transistor, in the first sub-circuit. Thus, the second sub-circuit is used to provide the bias voltage for the first transistor, in the first sub-circuit, and it is not necessary to provide any additional bias voltage therefor. This reduces the power required by the circuit, and also reduces the area of the circuit when it forms part of an integrated circuit device.

DETAILED DESCRIPTION OF PREFERRED EMBODIMENTS

Figure 1:
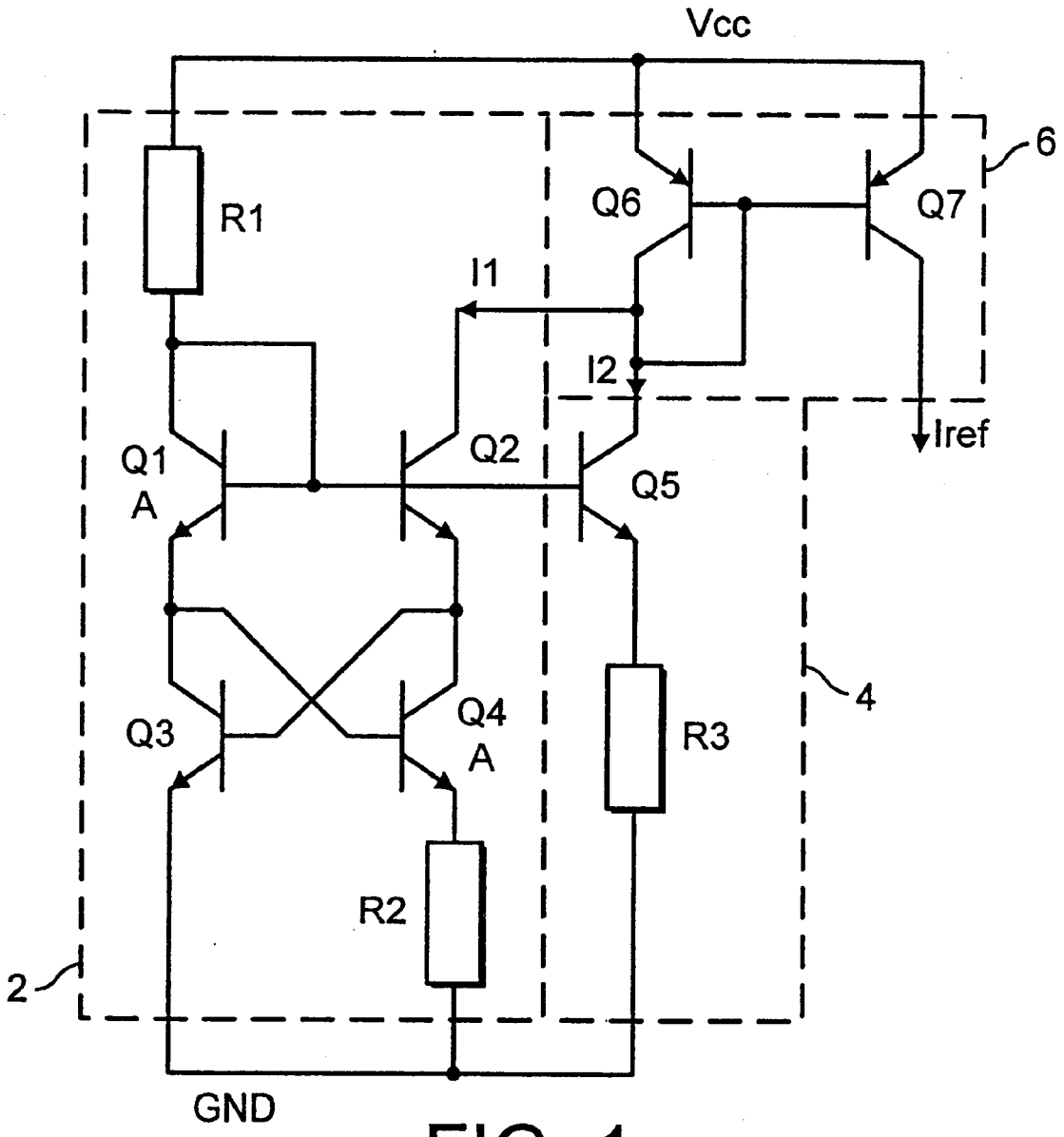
FIG. 1 is a circuit diagram of a circuit in accordance with the invention.

The circuit of FIG. 1 is made up of a positive temperature coefficient sub-circuit 2, a negative temperature coefficient sub-circuit 4, and a summing circuit 6.

The positive temperature coefficient sub-circuit 2 is made uo of NPN transistors Q1, Q2, Q3 and Q4, and resistors R1 and R2. Transistor Q1 has its base and collector terminals connected together, and connected to a positive voltage supply rail Vcc through a first resistor R1. The base of transistor Q1 is also connected to the base of transistor Q2. The ratio of the emitter area of transistor Q1 to the emitter area of transistor Q2 is A.

The emitter of transistor Q1 is connected to the collector of transistor Q3, and to the base of transistor Q4. The emitter of transistor Q2 is connected to the collector of transistor Q4, and to the base of transistor Q3. The ratio of the emitter area of transistor Q4 to the emitter area of transistor Q3 is also A.

The emitter of transistor Q3 is connected to ground, and the emitter of transistor Q4 is connected to ground through a second resistor R2.

The current drawn through the collector of transistor Q2 is indicated as I1.

The negative temperature coefficient sub-circuit 4 is made up of an NPN transistor Q5, and resistor R3. The base terminal of transistor Q5 is connected to that of the transistor Q2, and thus it is biased thereby. The emitter terminal of transistor Q5 is connected to ground through the resistor R3. The collector terminal of transistor Q5 is connected to the collector terminal of transistor Q2 at a current summing node.

The current drawn through the collector of transistor QS is indicated as I2.

The summing circuit 6 is effectively a current mirror, made up of PNP transistors Q6 and Q7. The base and collector terminals of transistor Q6 are connected together, and to the current summing node. Further, tine base terminals of transistors Q6 and Q7 are connected together, and the emitter terminals of transistors Q6 and Q7 are connected to the positive voltage supply Vcc.

The current drawn through the collector of transistor Q7 is indicated as Iref, and can then of course be supplied to any other circuit If desired, further transistors could be connected in the same way as transistor Q7, thereby providing the sane output current Iref to other circuits In the case of the positive temperature coefficient sub-circuit 2, the voltage which is developed across the resistor R1 is $U_T.\ln(A^2)$, where $U_T$ is the thermal voltage kT/q, k being Boltzmann's constant, T being the absolute temperature, and q being the charge on an electron. Thus, provided that the current gain, β, of the transistors is high, the current I1 in the collector of Q2 is given by:

$$I1=U_T.\ln(A^2)/R2$$

Thus, if the resistor R2 has zero temperature coefficient, Il is directly proportional to absolute temperature, and substantially independent of supply voltage and the value of R1.

In the case of the negative temperature coefficient sub-circuit 4, it must be noted that the base of transistor Q2 is biased to twice the base-emitter voltage of the transistors, and so the base of transistor Q5 is biased to the same voltage. Hence toe emitter of the transistor Q5 is biased to a level equal to one base-emitter voltage. It is known that a silicon diode junction voltage varies with temperature, the temperature coefficient being about −2 mV.K$^{-1}$.Thus, the collector current I2 through the transistor Q5 will be given by:

$$I2=(Vbe_{Q5}+k1.\Delta T)/R3,$$

where $Vbe_{Q5}$ is the base-emitter voltage of Q5 at one temperature, ΔT is the temperature variation from that temperature, and k1 is the temperature coefficient −2 mV.K$^{-1}$.

Thus, the output current, Iref, is given by:

$$Iref = \frac{U_T \times \ln A^2}{R2} + \frac{Vbe_{Q5} + k1 \cdot \Delta T}{R3}$$

This gives a temperature coefficient for the output current of:

$$\frac{\partial(Iref)}{\partial T} = \frac{\frac{k}{q} \times \ln A^2}{R2} + \frac{k1}{R3}$$

The ratio of the resistance values R3:R2 can therefore be selected to give any desired value of the temperature coefficient of the output current, including zero.

If R2 and R3 have negligible temperature coefficients, then the output current will have a zero temperature coefficient if:

$$\frac{R3}{R2} = \frac{k1}{\frac{k}{q} \times \ln A^2}$$

If the resistors do not themselves have zero temperature coefficients, as will be the case in practice, the ratio of the resistance values can be selected to account for that.

Figure 2:
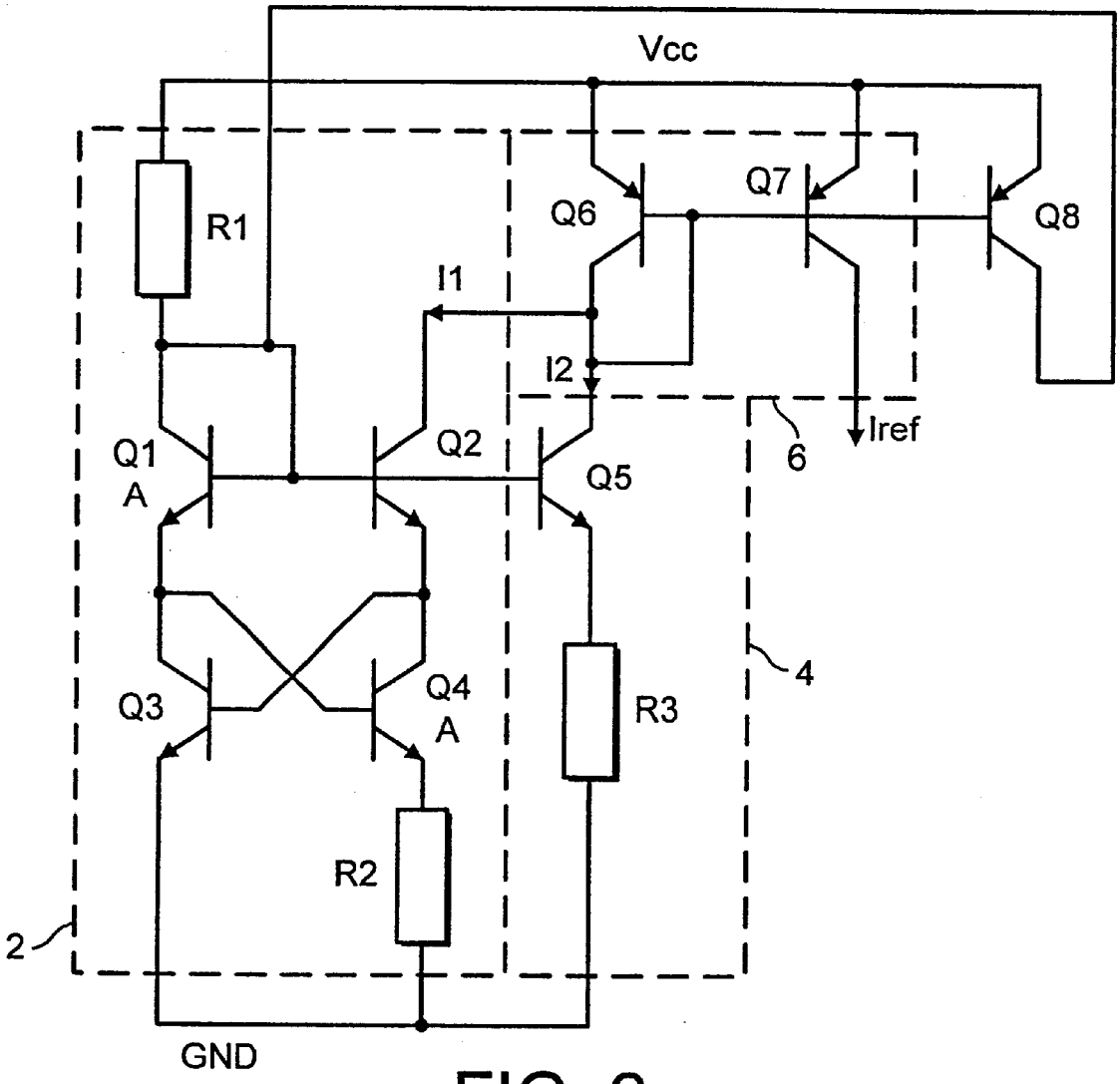
FIG. 2 is a circuit diagram of a second circuit in accordance with the invention.

FIG. 2 shows a modified circuit, in which components indicated with the same reference numerals used in FIG. 1 have the same functions. In order to improve the accuracy of the circuit shown in FIG. 1, a high value resistor can be used for the resistor R1, which generates the input current. The collector of a further PNP transistor Q8, connected in the same way as the transistor Q7, is connected to the base-collector junction of the transistor Q1. Then, after start-up, a current equal to the output current Iref is supplied to Q1. Since this current is then largely independent of fluctuations in the supply voltage, a source of possible inaccuracy in the output current is removed.

There is therefore provided a circuit which can provide a reference current with a desired temperature coefficient, including providing a temperature independent reference current, while using few components, and having low power consumption.

What is claimed is:

1. A current supply circuit, comprising a first current supply sub-circuit with a negative temperature coefficient, and a second current supply sub-circuit with a positive temperature coefficient, wherein the first current supply sub-circuit comprises:

a first bipolar transistor, the emitter terminal of which is connected through a first resistor to a first voltage supply rail, wherein the second current supply sub-circuit comprises:

second, third, fourth and fifth bipolar transistors, the bases of the second and third transistors being connected together, and to the collector terminal of the third transistor, the collector terminal of the third transistor being connected to a second voltage supply rail through a second resistor, the emitter of the second transistor being connected to the collector of the fourth transistor, and to the base of the fifth transistor, the emitter of the third transistor being connected to the collector of the fifth transistor, and to the base of the fourth transistor, the emitter of the fourth transistor being connected to the first voltage supply rail through a third resistor, and the emitter of the fifth transistor also being connected to the first voltage supply rail;

the current supply circuit further comprising means for summing the currents through the first transistor and the second transistor to produce an output current; and the base of the second transistor being connected to the base of the first transistor to provide a bias voltage therefor.

2. A current supply circuit as claimed in claim 1, wherein the ratio of the resistances of the first and second resistors is selected to give a desired temperature coefficient for the output current.

3. A current supply circuit as claimed in claim 2, wherein the desired temperature coefficient for the output current is zero.

4. A current supply circuit as claimed in claim 1, comprising a current mirror circuit, wherein the output current is mirrored to a current supply line connected to the base and collector of the third transistor.

* * * * *